US006177643B1

(12) United States Patent
Marin et al.

(10) Patent No.: US 6,177,643 B1
(45) Date of Patent: Jan. 23, 2001

(54) HIGH-VOLTAGE CIRCUIT-BREAKER HAVING AN AXIALLY DISPLACEABLE FIELD ELECTRODE

(75) Inventors: Heiner Marin, Berlin; Volker Lehmann, Treuenbrietzen; Hold Dienemann, Berlin, all of (DE)

(73) Assignee: Siemens Aktiengeselleschaft, München (DE)

( * ) Notice: Under 35 U.S.C. 154(b), the term of this patent shall be extended for 0 days.

(21) Appl. No.: 09/341,800

(22) PCT Filed: Jan. 19, 1998

(86) PCT No.: PCT/DE98/00190

§ 371 Date: Dec. 13, 1999

§ 102(e) Date: Dec. 13, 1999

(87) PCT Pub. No.: WO98/32142

PCT Pub. Date: Jul. 23, 1998

(30) Foreign Application Priority Data

| | | |
|---|---|---|
| Jan. 17, 1997 | (DE) | 197 02 822 |
| Jun. 26, 1997 | (DE) | 197 27 850 |
| Sep. 16, 1997 | (DE) | 197 41 660 |

(51) Int. Cl.[7] ..... H01H 33/18
(52) U.S. Cl. ..... 218/45; 218/84; 218/154
(58) Field of Search ..... 218/57, 65, 72, 218/73, 74, 78, 84, 92, 120, 140, 154

(56) References Cited

U.S. PATENT DOCUMENTS

| | | | | |
|---|---|---|---|---|
| 3,824,360 | | 7/1974 | Slamecka et al. . | |
| 5,561,280 | * | 10/1996 | Blatter | 218/59 |
| 5,780,799 | * | 7/1998 | David | 218/57 |
| 6,015,960 | * | 1/2000 | Girodet et al. | 218/43 |
| 6,049,050 | * | 4/2000 | David | 218/154 |

FOREIGN PATENT DOCUMENTS

| | | |
|---|---|---|
| 2 140 284 | 2/1973 | (DE) . |
| 42 17 232 | 11/1993 | (DE) . |
| 0 025 833 | 4/1981 | (EP) . |
| 0 696 040 | 2/1996 | (EP) . |

* cited by examiner

*Primary Examiner*—Lincoln Donovan
(74) *Attorney, Agent, or Firm*—Kenyon & Kenyon

(57) ABSTRACT

In a high-voltage circuit-breaker having arcing contact pieces that are movable relatively to each other, and an axially movable insulating nozzle, provision is made for an axially displaceable field electrode on the side lying opposite the drive. Used as an auxiliary drive for the field electrode is a first coupling shank which is connected to the axially movable insulating nozzle and which acts upon a gearing composed of a swivelling lever with a control pin a connecting link guide and a second coupling shank connected to the control pin and to the field electrode. For additionally driving the second arcing contact piece surrounded by the field electrode, the first coupling shank, with the assistance of a journal, also acts upon a deflection gear composed of a two-armed lever, having a fork-like design at one end for the coulisse-type guidance of the journal, and a pendulum element at the other end of the lever coupled to the second arcing contact piece.

8 Claims, 5 Drawing Sheets

HIGH-VOLTAGE CIRCUIT-BREAKER HAVING AN AXIALLY DISPLACEABLE FIELD ELECTRODE

RELATED APPLICATIONS

This application claims the benefit of PCT Application No. PCT/DE98/00190, filed on Jan. 19, 1998, and German Patent Application No. 197 02 822.5, filed on Jan. 17, 1997, German Patent Application No. 197 27 850.7, filed on Jun. 26, 1997, and German Patent Application No. 197 41 660.8, filed on Sep. 16, 1997.

FIELD OF THE INVENTION

The present invention is in the field of high-voltage circuit-breakers and is to be used in the structural design of an auxiliary gearing which is used to move switching elements located axially opposite the driven contact set of the circuit-breaker.

BACKGROUND INFORMATION

In circuit-breakers of this type, two arcing contact pieces, located coaxially opposite each other, are coaxially surrounded by the two continuous-current contact pieces, of which one is arranged in a fixed position and the other one is axially driveable. Circuit-breakers of this type generally operate with a gaseous quenching medium which, in a switching operation, is first compressed and then flows through the separation area of the two arcing contact pieces, it being possible to influence its flow by special pressure spaces and nozzles. Used for this purpose, inter alia, is an insulating nozzle which is arranged inside the continuous-current contact pieces and surrounds the arcing contact pieces, and which is firmly connected both to the driveable continuous-current contact piece and to the driven arcing contact piece.

In a known circuit-breaker described in, for example, (European No. 0 696 040), a field electrode, which is secured to the end of the insulating nozzle facing away from the first driven arcing contact piece and can be axially displaced together with the insulating nozzle, surrounds the second arcing contact piece and, when the circuit-breaker is in the OFF position, influences the electric field in the area of the other arcing contact piece and of the electrically heavy-loaded end of the insulating nozzle. In addition, in this circuit-breaker, the second arcing contact piece can be driven in the opposite direction of the first arcing contact piece. To this end, a driving element is secured to the axially displaceable field electrode, and thus to the insulating nozzle, the driving element transferring the driving motion of the driven continuous-current contact piece to the second arcing contact piece as well, using a deflection (corner) gear. Therefore, the second arcing contact piece is guided in a sliding contact. The driving element in the deflection gear is designed as a gear rack which either acts via a gear wheel upon the second arcing contact piece, also designed as a gear rack, or which drives a thrust crank whose rotating part is formed by a gear wheel.

In this circuit-breaker, the field electrode secured to the insulating nozzle follows the full stroke (travel) of the contact pieces; that means that in the ON position, the field electrode is inserted relatively far into the fixed continuous-current contact piece, requiring a corresponding space. The movement of the second arcing contact piece is also linked to the full stroke of the driven contact pieces.

SUMMARY

An object of the present invention is to optimize the sequence of motion of the field electrode, while shortening its stroke, and optionally, to improve the interaction with a driving mechanism for the second arcing contact piece.

To achieve this objective, according to the present invention, the field electrode is displaceable by a gearing which is includes of a first coupling shank that is connected via the insulating nozzle to the driveable continuous-current contact piece and runs in the direction of the longitudinal axis of the circuit-breaker, of a second coupling shank that runs parallel to the first coupling shank and is connected to the field electrode, and of a lever that is attached to the first coupling shank in a manner allowing the lever to swivel, a pin being secured to the swivelling part of the lever, passing through its swivel plane, the second coupling shank being connected to the pin, and the pin engaging with a connecting link guide that is incorporated in a plate which is fixedly joined to the second continuous-current contact piece. The and the connecting link guide 13 designed in such a way that its first section runs approximately parallel to the longitudinal direction of the first coupling shank and its second, curved section allows the pin to deflect in a direction perpendicular to the longitudinal axis of the circuit-breaker.

Such a gearing permits the field electrode to be moved separately and independently of the driveable arcing contact piece, so that the speed and the travel of the field electrode can be different from that of the first arcing contact piece, the characteristic of the displacement movement being selectively predefinable in the form of a speed profile.

The special feature of the gearing lies in the lever swing-mounted on the first coupling shank, together with the pin secured to the swivel arm of the lever and guided in a stationary connecting link guide. A first section of the connecting link guide runs in a direction nearly parallel to the longitudinal direction of the first coupling shank. In this area, the pin is moved along the connecting link guide during the movement of the first coupling shank, without the lever swinging out. It is only in the second section of the connecting link guide, which allows the pin to deflect in a direction perpendicular to the longitudinal direction in which the coupling shank is moved, that the lever swings out, and the pin moves, at least with one motion component, in a direction perpendicular to the longitudinal direction of the first coupling shank. In this manner, the motion component of the pin in a direction parallel to the longitudinal direction of the first coupling shank (longitudinal axis of the circuit-breaker) is slowed down and finally stops, the lever further swinging through and the pin only moving in a direction perpendicular to the longitudinal direction. Since the field electrode is coupled to the pin via the second coupling shank, the speed of the field electrode in a direction parallel to the longitudinal direction of the shank is reduced during this last phase of motion until it comes to a standstill.

Consequently, the connecting link guide allows the field electrode to be moved in the same direction as the first coupling shank but at a different speed and a variable transmission ratio. This continues until the pin and, with it, the field electrode no longer moves in the longitudinal direction, while the first coupling shank is moved further. Thus, during the breaking operation, the field electrode can initially be moved together with the first arcing contact piece at the beginning of the movement, however, can be stopped before the movement of the first arcing contact piece ends, i.e., the traveling distance of the field electrode is shortened compared to the traveling distance of the first arcing contact piece.

One advantageous embodiment of the present invention provides for the curved second section of the connecting link guide to have a first end area adjacent to the first section and running in the direction of the first section, and a second end area running in a direction nearly perpendicular to the first section. This design of the connecting link guide allows the field electrode to move at the same speed as the first coupling shank as long as the pin is in the first section of the connecting link guide, and to slow down while the pin is in the second section of the connecting link guide. The second section of the connecting link guide expediently faces the driveable arcing contact piece. Because of this, in response to a tension movement of the first coupling shank during the breaking operation of the circuit-breaker, the pin is moved in the second section of the connecting link guide toward the end of the breaking movement, so that the speed of the field electrode then decreases to a standstill.

In a further advantageous refinement of the present invention, the second coupling shank, attached to the field electrode, can be connected to a cross-member which is supported in a manner that it is displaceable in the direction of the longitudinal axis of the circuit-breaker, and which has a slit, running in a direction perpendicular to the longitudinal axis of the circuit-breaker, with which the pin, secured to the lever, engages. Such a slit allows the necessary pin movements perpendicular to the longitudinal axis of the circuit-breaker, the pin being used to transmit the driving motion to the cross-member, running perpendicularly to the longitudinal direction of the first coupling shank, and from there to the field electrode.

The gearing according to the present invention can be arranged on the side of the high-voltage circuit-breaker opposite the drive, i.e., behind the field electrode as viewed from the first arcing contact piece, to prevent the gearing from being dielectrically loaded by the field strength prevailing in the area between the arcing contact pieces.

In a further refinement of the high-voltage circuit-breaker it is advantageous to combine the driving mechanism for the field electrode with a drive for the second arcing contact piece, namely, in such a way that the second arcing contact piece is driven only over a portion of the length of travel of the activating first continuous-current contact, and that during this driving phase, the second arcing contact piece, which is driven in the opposite direction, passes through a defined speed maximum at a predeterminable location. This is expediently effected in that the second arcing contact piece is guided in a sliding contact and can be driven in the opposite direction of the first arcing contact piece, in that the first coupling shank is provided with a journal pin which is arranged transversely to the direction of thrust and which actuates a deflection corner gear to drive the second arcing contact piece, the deflection gear including a two-armed control lever having two stable end positions, one of the two ends of the lever having a fork-like design for the coulisse-like accommodation of the journal, and the other being linked to the second arcing contact piece via a pendulum element. The stationary parts of the gearing for the field electrode and the stationary parts of the deflection gear for the second arcing contact piece are arranged in tandem in the axial direction of the circuit-breaker on a shared plate.

The design provided for the deflection gear allows the movement of the second arcing contact piece to be adjusted to the movement of the field electrode in such a way that the second arcing contact piece remains in neutral position during the compression stroke of the circuit-breaker, is rapidly moved in the opening direction during the disconnect stroke and brought into the disconnected position, and remains in neutral position again during the extinction stroke. The design of the deflection gear is distinguished by the use of a small number of simple, light parts, so that the deflection gear has very small moving masses and represents an assembly which is closed upon itself and can have a flat design, and therefore does not obstruct the flow of the insulating gas (waste gas) forming in the fixed continuous-current contact during the switching operation. Furthermore, the deflection gear has a transmission ratio which varies during the actuating operation, is formed like a sinusoidal half-wave and can be more than 1:1 at the peak, i.e., during the crucial phase of the breaking operation (phase of contact separation and increasing contact clearance), the second arcing contact piece, driven in the opposite direction, can be moved at a greater speed than the first arcing contact piece. In this process, the deflection gear is driven by the same coupling shank which is also used to drive the gearing for the field electrode. To this end, a journal is arranged at the first coupling shank, forming the movable part of the deflection gear—analogously to the swivelling lever of the gearing for the field electrode. Since the gearing for the field electrode and the deflection gear for the second arcing contact piece are arranged on a shared plate one behind the other in the axial direction of the circuit-breaker, the result is a compact, flat gear unit, which—separately mountable—can be inserted into the discharge area of the quenching gas without obstructing the flow of the quenching gas, and without requiring an increase in the overall length of the circuit-breaker. Moreover, this has the advantageous effect that the two gearings are jointly coupled to the insulating nozzle by way of one or two first coupling shanks, and consequently, the bearings for the axially moved gear parts are also effective for both gearings. Due to the arrangement of the deflection gear in the immediate proximity of the second arcing contact piece, a relatively large distance must be bridged between the field electrode and the gearing assigned to it, which is achieved with the assistance of the second coupling shank. Since the gearing for the field electrode lies axially behind the second arcing contact piece, the very flat design of this gearing can be retained as well.

The pendulum element provided for linking the control lever to the second arcing contact piece can be a connecting rod or a journal which engages with an oblong hole on the second arcing contact piece.

In order to have the second arcing contact piece pass through a defined maximum speed at a predeterminable location, the deflection gear is expediently designed in such a way that the first coupling shank is guided along a bearing cheek (side wall) of the plate. The rotary axle of the two-armed control lever is located between the first coupling shank and the axis of the second arcing contact piece, and at the same time is fixedly joined to the shared plate. The two-armed control lever, when in its stable end positions, runs at an angle with respect to the first coupling shank and the axis of the second arcing contact piece. The fork-like end of the control lever is provided with an elongated, mouth-like opening between the two prongs.

The further journal mounted at the other end of the control lever is also arranged transversely to the direction of thrust of the first coupling shank. The oblong hole with which this journal engages is located in a headpiece arranged on the second arcing contact piece. The headpiece, for its part, is axially guided in the sliding bearing joined to the stationary part of the sliding contact. The fork-like shape of the one end of the control lever can be so designed relative to the mouth-like opening, that the axial movement can be guided truly into and out of the second arcing contact piece. To ensure reliable guidance of the control lever in its three positions—"off position", "motion phase" and "on position"—with as compact a type of construction as possible, in a further development of the present invention, the first coupling shank has a guideway which is provided with an opening that clears the field of traverse of the fork-shaped end of the control lever, and the two prongs of the fork-shaped end of the control lever can be provided on the outside with flattenings for the contact of the control lever against the guideway of the first coupling shank in the two end positions of the control lever. Furthermore, for stabilizing these two end positions, provision can expediently be made for two stops, fastened to the shared plate and thus to the stationary part of the sliding bearing, with which the control lever makes contact with one of its respective flattenings. This rules out an overswing of the control lever after the pin disengages from the fork-like end of the control lever.

BRIEF DESCRIPTION OF THE DRAWINGS

FIGS. 3 through 10 show a second exemplary embodiment of an interrupter unit of a high-voltage circuit-breaker having a combination of a gearing for the field electrode and a deflection gear for the second arcing contact piece, of which.

FIG. 3 shows the allocation of the deflection gear to the shared plate secured to the fixed continuous-current contact piece of the circuit-breaker, and specifically in the one end position.

FIGS. 4 and 5 show the plate accommodating the stationary parts of the two gearings in a side and a front view.

FIG. 6 shows a cross-section through the gearing for the field electrode.

FIG. 7 shows a cross-section through the deflection gear for the second arcing contact piece.

FIGS. 8 through 10 show the deflection gear in two intermediate positions and the other end position of the control lever.

DETAILED DESCRIPTION

Figure 1:
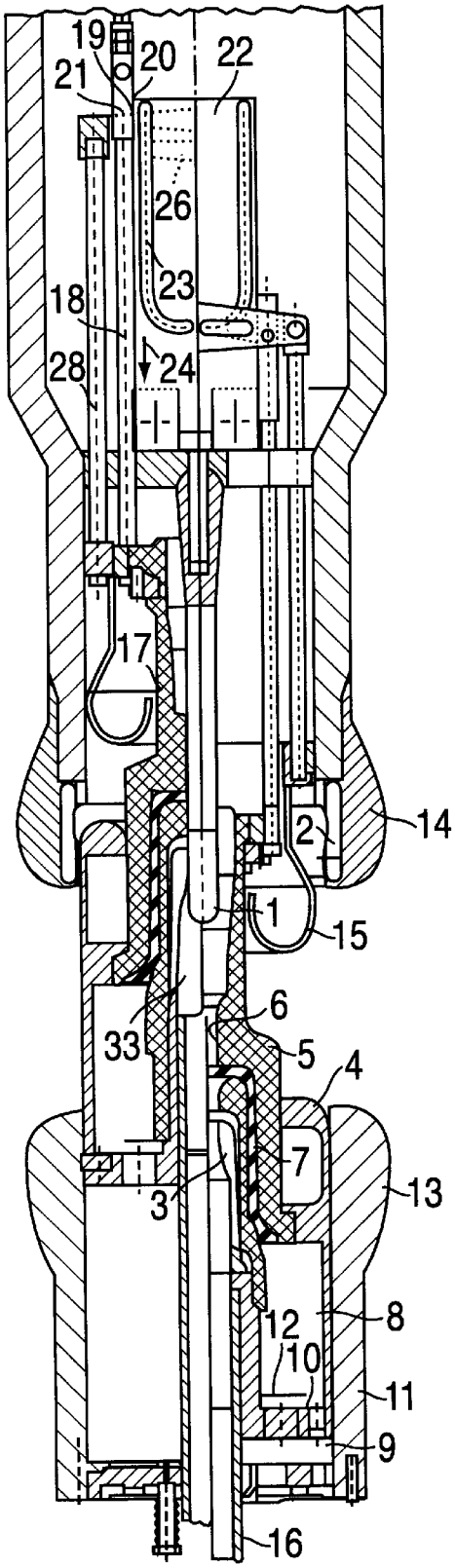
FIG. 1 shows a longitudinal section of a first exemplary embodiment of an interrupter unit of a high-voltage circuit-breaker having a gearing for driving a field electrode.

The interrupter unit shown in FIG. 1 has in the upper portion a fixed arcing contact piece 1 and a fixed continuous-current contact piece 2, opposite which are a drivable first arcing contact piece 3 and a drivable continuous-current contact piece 4. The left half-section shows the closed-circuit condition, in which driveable first arcing contact piece 3 embraces a fixed, pin-shaped second arcing contact piece 1, and driveable continuous-current contact piece 4 has been inserted into fixed continuous-current contact piece 2. The right half-section shows the open position, in which the continuous-current contacts and the arcing contacts are separated from each other by an isolating distance.

Drivable first arcing contact piece 3 is surrounded by an insulating nozzle 5 which is firmly joined to the drivable contact pieces of the circuit-breaker and whose narrow nozzle spot 6 has a diameter which corresponds to the outside diameter of fixed second arcing contact piece 1. Insulating nozzle 5 has a channel 7 which, in the case of an arc drawn between the arcing contacts, allows hot quenching gas to flow into a heating chamber 8, where it is kept available for a subsequent blow-out of the arc during the current zero of the current to be switched.

Arranged downstream of heating chamber 8 is a compression chamber 9 in which quenching gas such as $SF_6$ is compressed by compression piston 10 which is also driven inside fixed compression cylinder 11 in the course of the breaking movement. As soon as the quenching gas pressure in compression chamber 9 is higher than in heating chamber 8, quenching gas flows through check valve 12 into the heating chamber. Otherwise, flow from heating chamber 8 into compression chamber 9 is blocked to prevent the drive from being loaded by excessive pressure in the compression chamber.

Continuous-current contact pieces 2, 4 are surrounded by fixed screening electrodes 13, 14, which are intended to even out the electric field between the contacts in the breaking operation. In addition, provision is made for a movable field electrode 15 which is shown in closed position in the right half-section, and in the open position in the left.

The operating mechanism, which is not shown in the Figure, acts upon contact tube 16 which supports driveable first arcing contact 3. Both the nozzle and the compression device are moved together with driveable first arcing contact piece 3. By this means, during a breaking operation, driveable arcing contact piece 3 and drivable continuous-current contact piece 4 are detached from the respective counter-contacts, and the insulating nozzle is moved so far that the narrow nozzle spot is cleared from fixed arcing contact piece 1. Subsequently, the quenching gas from the arc area can escape past fixed second arcing contact piece 1 upward into other areas of the switching vessel.

Figure 2A:
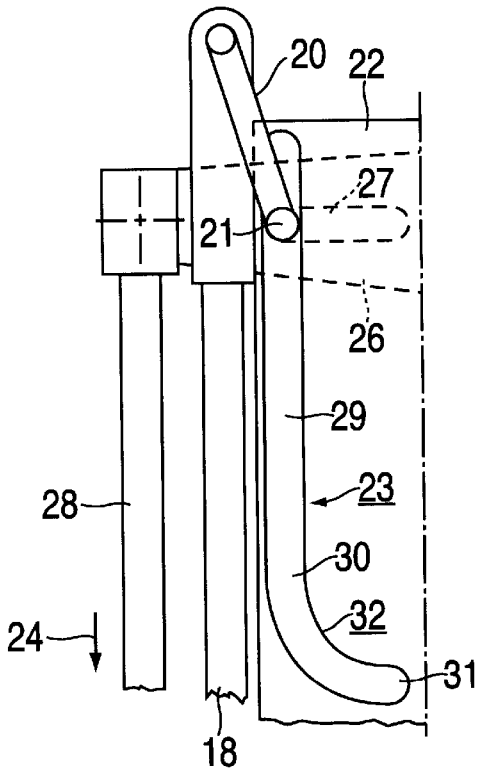
FIGS. 2*a* and 2*b* show a portion of the gearing from FIG. 1 in two different positions.
Figure 2B:
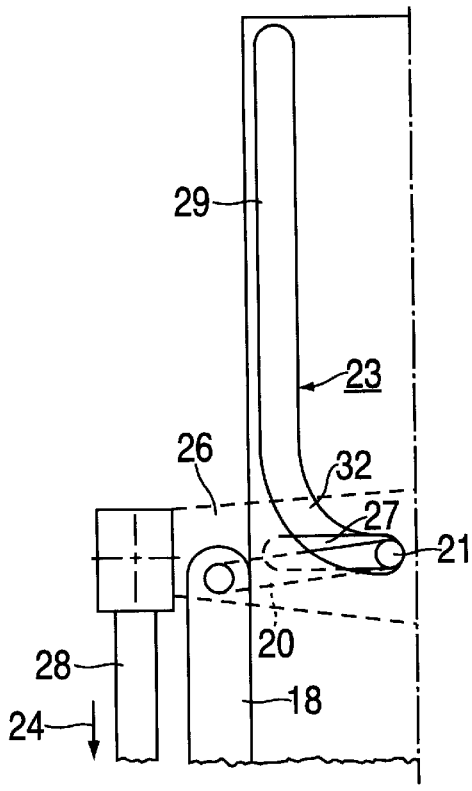

The free end 17 of the insulating nozzle is joined to a first coupling shank 18 by, for example, a ring secured to the nozzle end and embracing it. At the free end of first coupling shank 18, swing-mounted in a hinge point 19, is a lever 20 which bears a pin 21 at its swivelling end. The longitudinal axis of this pin is perpendicular to the drawing plane, or rather, to the swivel plane of lever 20. Arranged in the line of vision in front of and in back of lever 20 is in each case one sheet-metal plate 22, provision being made in each case in sheet-metal plates 22 for two connecting link guides 23 in the form of milled slots aligned with one another. Pin 21 moves in these connecting link guides 23 while first coupling shank 18 is in motion. The embodiment is symmetrical so that a first coupling shank 18 or a lever 20 and a pin 21 belong to each of the connecting link guides. The symmetrical design is not absolutely necessary. However, a symmetrical design reduces the risk of canting. By designing each connecting link guide in the form of two sheet-metal plates 22 arranged on both sides of, and parallel to, the longitudinal axis of the circuit-breaker, the flow-off of quenching gas in this axial direction is not obstructed. Therefore, there is also no fear of this device or the gearing becoming corroded by the influence of hot quenching gases. During a breaking movement, first coupling shank 18 is accelerated in the direction of arrow 24. Since connecting link guide 23, in its first section 29 (FIG. 1, left half-section), runs parallel to the longitudinal direction of first coupling shank 18, the angle between lever 20 and first coupling shank 18 does not change at first, i.e., pin 21 moves at the same speed as first coupling shank 18 up to first end area 30 of second section 32 (see also FIG. 2*a*).

As soon as pin 21 enters curved second section 32 of connecting link guide 23, lever 20 swings out further anti-clockwise and pin 21 moves radially away from first coupling shank 18. The speed of pin 21 in a direction parallel to the movement of first coupling shank 18 decreases until the pin moves only horizontally in end area 31 of second section 32, and lever 20 assumes a nearly horizontal position. At the end of this area (i.e.,the remaining stroke), the movement of the first coupling shank has ended and the circuit-breaker is in the open position.

During this movement, which at the beginning takes place at the same speed as that of first coupling shank 18 and is later retarded, pin 21 actuates a cross-member 26 which has a slit 27 for this purpose, in which pin 21 can move horizontally relative to the cross-member. Joined to cross-member 26 is second coupling shank 28, or a pair of two coupling shanks, to whose lower end field electrode 15 is secured.

During the breaking movement, the described gearing causes field electrode 15 to initially move with the same speed as the contact pieces toward the isolating distance, that is to say, toward arcing space 33. However, the path covered by field electrode 15 is not as large as the path of the contact pieces and, as shown in the right half-section of FIG. 1, field electrode 15 remains in a position in which it, together with screening electrode 14 and fixed arcing contact piece 1, generates an optimum field contour. This electrode position is reached before the stroke ends, so that optimum screening is achieved during the remaining stroke, i.e., during the arc quenching.

A gearing of the type described is necessary because the field electrode must give way sufficiently far in the closed-circuit condition (see FIG. 1, left half-section) to allow sufficient space for insulating nozzle 5, however, it must already have assumed the optimum position at the beginning of the quenching operation to ensure the extinction of the arc.

During the making operation, the described phases are run through in reverse order. Initially, the field electrode moves slowly, and faster toward the end of the making movement. In so doing, it is accelerated "smoothly", thus avoiding force peaks.

The described gearing ensures that, by permanent forcing, the field electrode assumes the most favorable position for the dielectric conditions in each phase of the switching motion.

The described circuit-breaker is also symmetrical with regard to the gearing design, including identical parts in both halves of FIG. 1 shown. This promotes functional reliability and symmetry of the individual forces (preventing canting and transverse forces); in principle, however, the gearing can also have only a unilateral design.

With reference to FIGS. 1, 2A and 2B, FIG. 3 shows a cutaway view of fixed continuous-current contact 2 of a high-voltage circuit-breaker, into which axially driveable continuous-current contact piece 4, not shown here, including insulating nozzle 5 secured to it, as well as first, axially driveable arcing contact piece 3, likewise not shown here, moves from the left. The Figure shows the closed position of the driveable continuous-current contact piece, together with insulating nozzle 5. In this closed position, insulating nozzle 5 surrounds reversely-driven, second arcing contact piece 25 over its entire length. Secured to end 17 of insulating nozzle symmetrically to the longitudinal axis of the circuit-breaker, are two first coupling shanks 18 which, on the one hand, drive field electrode 15 via two levers 20 that are provided with a pin 21, and via connecting link guide 23, cross-member 26 and second coupling shanks 28, and of which, on the other hand, the lower first coupling shank additionally has a journal 35 for driving arcing contact piece 25 with the assistance of a deflection gear, journal 35 being arranged transversely to the direction of thrust of lower first coupling shank 18 provided with a U-shaped cross-section. Lower first coupling shank 18 can also have an L- or T-shaped cross-section, in each case one cross-sectional part providing a sliding surface for guiding coupling shank 18 along a bearing cheek 57 formed on plate 56.

Figure 3:
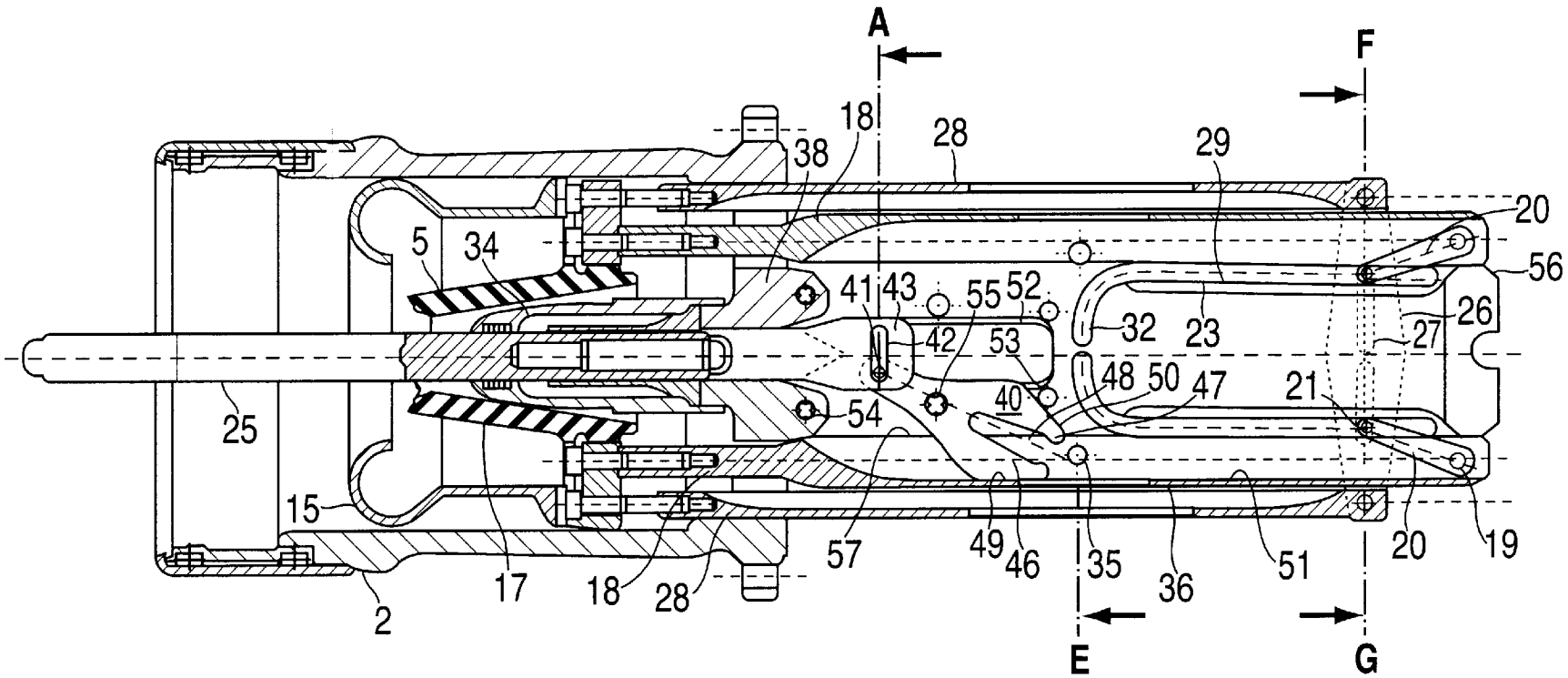
Figure 4:
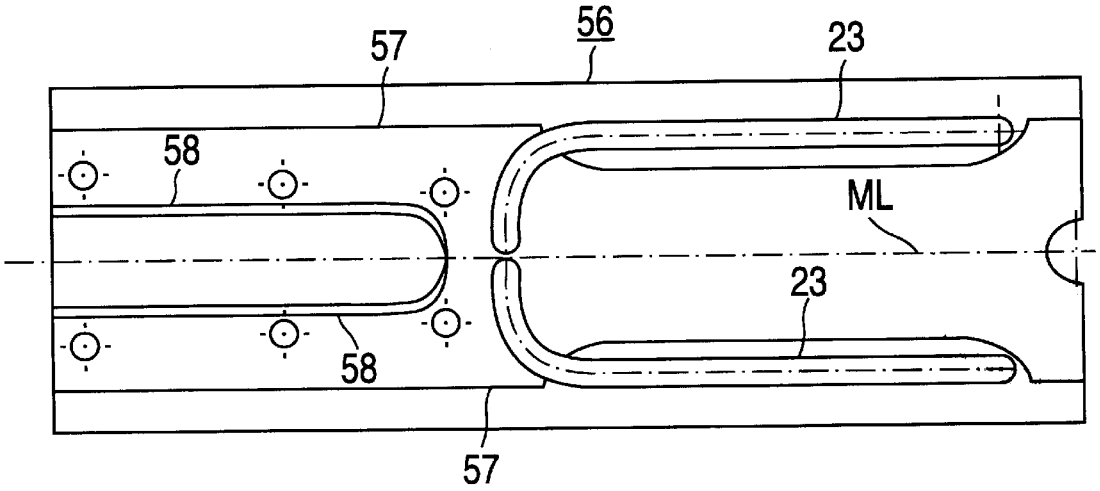
Figure 5:
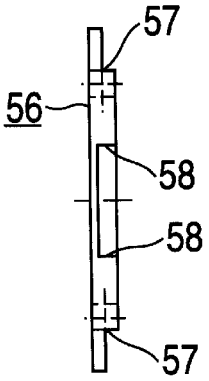

Plate 56 is attached to contact bridge 38 of a sliding contact 34 connected to fixed continuous-current contact piece 2 and, according to FIGS. 4 and 5, is provided with two bearing cheeks 57 which are arranged in the longitudinal direction symmetrically to center line ML and are used to guide upper first coupling shank 18 provided for driving field electrode 15, and to guide lower first coupling shank 18 provided for driving both field electrode 15 and second arcing contact piece 25. Further incorporated in plate 56 are two bearing cheeks 58 for guiding a flat head 43, shown in FIG. 3, which is located at the rearward end of second arcing contact piece 25. Connecting link guides 23 for pins 21 of the gearing for field electrode 15 are also incorporated in plate 56. Bearing cheeks 58 and connecting link guides 23 are arranged in tandem in the longitudinal direction of plate 56, bearing cheeks 58 facing arcing space 33 (FIG. 1).

Figure 6:
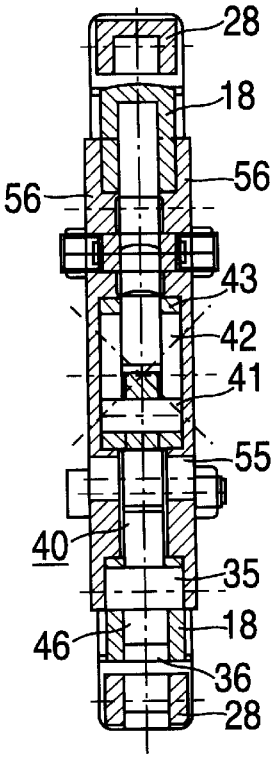

According to FIG. 6, which shows a cross-section along intersection line F-G in FIG. 3, two plates 56 are arranged in mirror symmetry to the longitudinal axis of the high-voltage circuit-breaker and are surrounded by a cross-member 26; on the one hand, this cross-member interconnects both second coupling shanks 28; on the other hand, the two side walls 59 and 60 are provided with vertical slits 27 to receive pins 21. Cross-member 26 also surrounds both first coupling shanks 18, these being spaced from second coupling shanks 28 by two separator pieces 61.

According to FIG. 3, second arcing contact piece 25, which is drivable in the opposite direction of first arcing contact piece 3, is provided at its end facing away from arc gap 33 (FIG. 1) with flat head 43 that is guided in bearing cheeks 58 of plates 56. Flat heat 43 is provided with an oblong hole 42 running vertically to first coupling shank 18.

Figure 7:
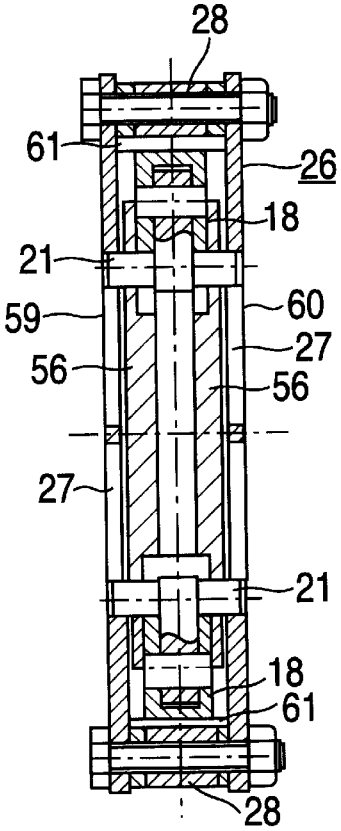

According to FIG. 3 and the cross-section along intersection line A-E represented in FIG. 7, to drive second arcing contact piece 25, a two-armed control lever 40 is supported in plates 56 on a rotary axle 55 running vertically to the drawing plane, one end of the control lever having a fork-shaped design, and its other end being provided with a journal 41. Journal 41 engages with oblong hole 42 on head 43. The fork-shaped end has two prongs 46 and 47, encircling a mouth-like opening 48 with which journal 35 of lower first coupling shank 18 can engage. The two prongs 46 and 47 are provided on the outside with a contact surface 49 and 50, respectively, with which control lever 40 - depending on its position —makes contact against the slideway formed by bottom 51 of the U-shaped cross-sectional profile of lower first coupling shank 18. Stops 53 and 54 on plates 56 ensure that control lever 40 remains in the respective contact position. The two contact positions represent end positions, between which control lever 40 is moved by the action of journal 35. To allow the fork-like end to rotate about rotary axle 55, lower first coupling shank 18 is provided with an oblong slit 36 in bottom 51 of the U-shaped cross-section. A slit of the same kind is optionally provided in lower second coupling shank 28.

Figure 8:
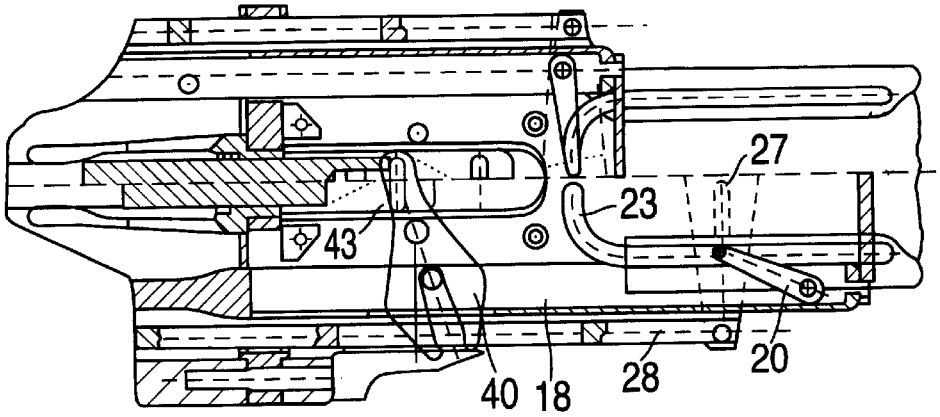
Figure 9:
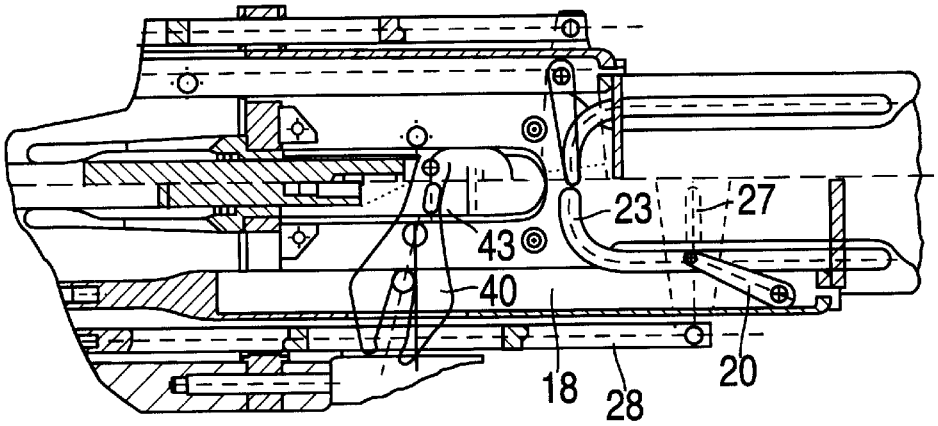
Figure 10:
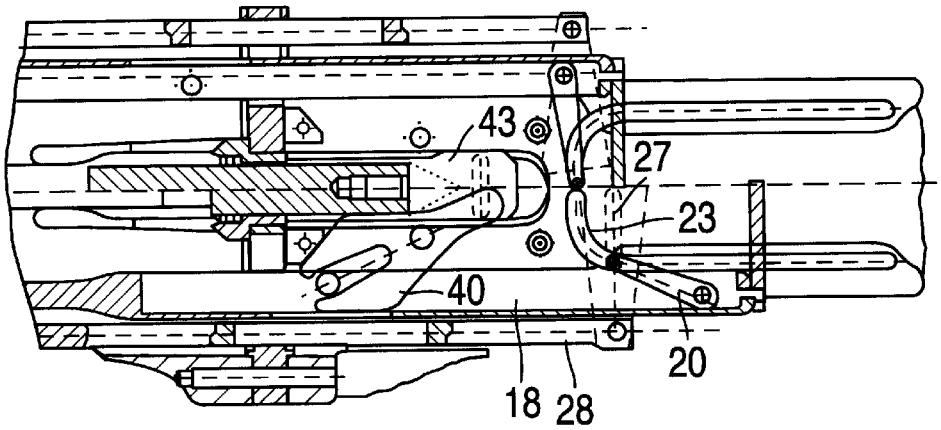

During a breaking movement, first coupling shank 18, and thus journal 35, continuously pass through different intermediate positions starting from the position shown in FIG. 3, FIGS. 8 and 9 showing those positions which head 43, and thus the associated reversely-driven arcing contact piece 25 assume shortly before and shortly after reaching the maximum speed, and FIG. 10 showing the other end position of control lever 40. Subsequent to the position according to FIG. 10, first coupling shank 18 can move still further to the left without control lever 40 changing its position. In the upper portion of FIGS. 8 through 10, coupling shanks 18 and 28, head 43 and lever 20 are each shown in the one end position.

Lever 20 as well as connecting link guide 23 for driving field electrode 15, and control lever 40 for driving second arcing contact piece 25 can be dimensioned in such a way that the field electrode has reached its end position after approximately two thirds of the length of travel of continuous-current contact piece 4 and of first arcing contact piece 3, and that second arcing contact piece 25 is driven only during a middle portion of the length of travel, and assumes its end position before field electrode 15 has reached its end position.

What is claimed is:

1. A high-voltage circuit-breaker, comprising:

a fixed contact carrying a persistent current;

an axially drivable contact carrying the persistent current;

a first arcing contact and a second arcing contact, the first arcing contact and the second arcing contact coaxially surrounded by the fixed contact;

an insulating nozzle firmly connected to the drivable contact and to the first arcing contact;

an axially displaceable field electrode surrounding the second arcing contact; and gearing displacing the field electrode, the gearing including:

a first coupling shank coupled via the insulating nozzle to the drivable contact, the first coupling shank extending in a direction of a longitudinal axis of the circuit-breaker, a second coupling shank extending parallel to the first coupling shank and coupled to the field electrode, a swivel-mounted lever coupled to the first coupling shank, a pin secured to a swivelling portion of the lever and passing through a swivelling plane of the lever, the second coupling shank being coupled to the pin, and a plate coupled to the second coupling shank and having a connecting link guide, the pin engaging with the connecting link guide, the connecting link guide having a first section extending in a direction one of parallel and nearly parallel to a longitudinal direction of the first coupling shank, and having a second curved section allowing the pin to deflect in a direction one of perpendicular and nearly perpendicular to the longitudinal direction of the first coupling shank.

2. The high-voltage circuit-breaker according to claim 1, wherein the second curved section of the connecting link guide forms a quarter of a circle and has a first end area adjacent to the first section and extending in a direction of the first section, and a second end area extending in a direction one of perpendicular and nearly perpendicular to the first section.

3. The high-voltage circuit-breaker according to claim 2, wherein the second curved section of the connecting link guide faces the first arcing contact.

4. The high-voltage circuit-breaker according to claim 1, further comprising:

a cross-member supported in a manner so that the cross member is displaceable in the direction of the longitudinal axis of the circuit-breaker, the second coupling shank coupled to the cross-member, the cross-member having a slit extending in a direction one of perpendicular and nearly perpendicular to the longitudinal axis of the circuit-breaker, the pin engaging the slit.

5. The high-voltage circuit-breaker according to claim 1, further comprising:

a sliding contact, the second arcing contact being guided in the sliding contact and being driven in an opposite direction of the first arcing contact;

wherein to drive the second arcing contact, the first coupling shank has a first journal arranged transversely to a direction of thrust and driving a deflection gear, the deflection gear including a two-armed control lever having two stable end positions, a first end of the lever having a fork-like design for a coulisse-type guidance of the first journal, a second end of the lever being linked to the second arcing contact via a pendulum element, and wherein stationary parts of the gearing for the field electrode and of the deflection gear for the second arcing contact are arranged in tandem on a shared plate in an axial direction of the circuit-breaker.

6. The high-voltage circuit-breaker according to claim 5, wherein the pendulum element has a second journal at the second end of the lever and an oblong hole on the second arcing contact, the second journal engaging the oblong hole.

7. The high-voltage circuit-breaker according to claim 5, wherein the first coupling shank is guided along a bearing cheek of the shared plate, and wherein the lever includes a rotary axle, the rotary axle of the lever being located between the first coupling shank and an axis of the second arcing contact, the rotary axle being fixedly joined to the shared plate, and wherein the lever, when in one of the stable end positions, runs at an angle with respect to the first coupling shank and the axis of the second arcing contact, wherein the fork-like portion of the lever is provided with an oblong, mouth-like opening between two prongs, and wherein the further journal is arranged transversely to the direction of thrust of the first coupling shank.

8. The high-voltage circuit-breaker according to claim 7, wherein the first coupling shank has a guideway provided with an opening, clearing a field of traverse of the fork-shaped end of the lever, and wherein the two prongs are provided on an outside portion with flattenings for contact of the lever against the guideway of the first coupling shank in the two stable end positions of the lever.

* * * * *